United States Patent [19]

Lacroix

[11] 4,035,000

[45] July 12, 1977

[54] SKIS

[76] Inventor: Daniel Lacroix, 76, route du Vivier - Bois d'Amont, 39220 Les Rousses, France

[21] Appl. No.: 713,962

[22] Filed: Aug. 12, 1976

Related U.S. Application Data

[63] Continuation of Ser. No. 566,062, April 8, 1975, abandoned.

[30] Foreign Application Priority Data

Apr. 9, 1974 France ..... 74.12477

[51] Int. Cl.[2] ..... A63C 5/00

[52] U.S. Cl. ..... 280/610

[58] Field of Search ..... 280/610, 602, 608, 609

[56] References Cited

U.S. PATENT DOCUMENTS

| | | | |
|---|---|---|---|
| 3,132,874 | 5/1964 | Baudou | 280/610 |
| 3,415,529 | 12/1968 | Grill et al. | 280/602 |

FOREIGN PATENT DOCUMENTS

| | | | |
|---|---|---|---|
| 2,028,293 | 9/1970 | France | 280/610 |
| 1,283,134 | 11/1968 | Germany | 280/610 |
| 1,428,862 | 12/1968 | Germany | 280/610 |

*Primary Examiner*—Joseph F. Peters
*Assistant Examiner*—David M. Mitchell
*Attorney, Agent, or Firm*—Robert E. Burns; Emmanuel J. Lobato; Bruce L. Adams

[57] ABSTRACT

A ski has a polyurethane core cut into three side-by-side sections, sandwiched between an upper and a running sole with interposed layers of stratified glass fibers in an epoxy resin. Solely the central part of the core is encased in and reinforced by a further layer of glass fibers in an epoxy resin, including an inner stratum of random fibers and an outer stratum of fibers extending along the entire length of said central part.

8 Claims, 10 Drawing Figures

FIG. 1a
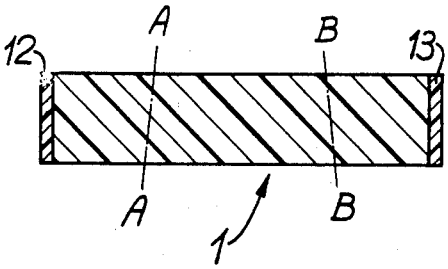
FIG. 1b
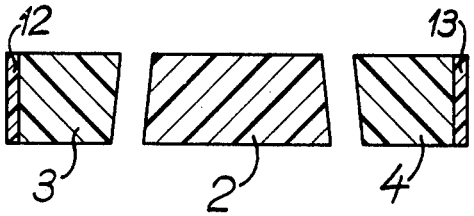
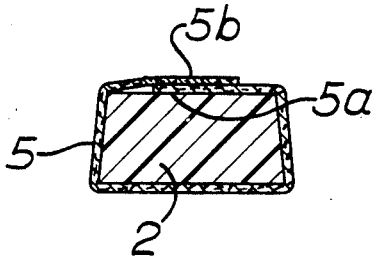
FIG. 1c
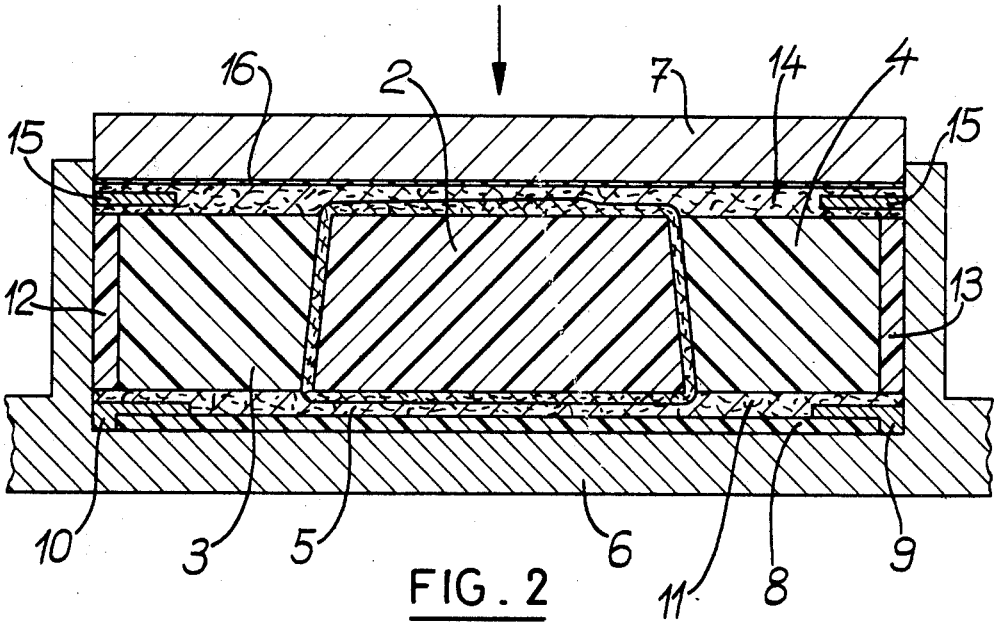
FIG. 2

FIG. 7
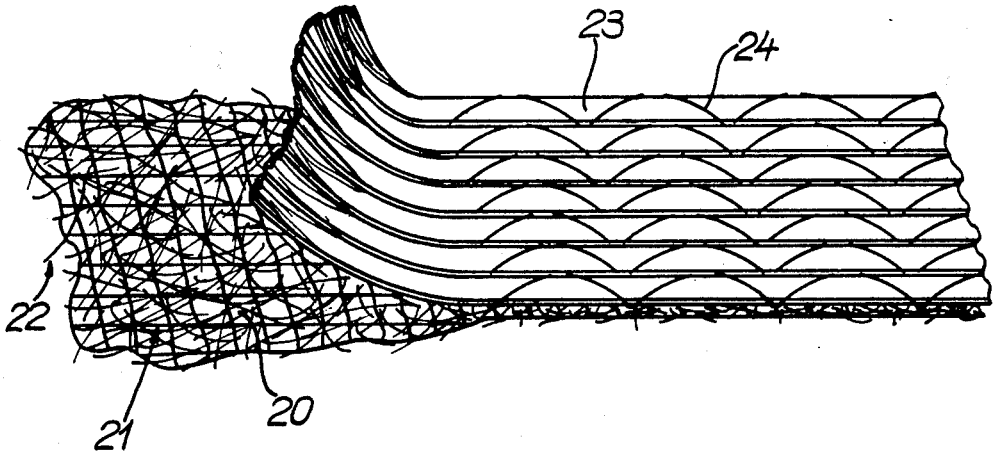
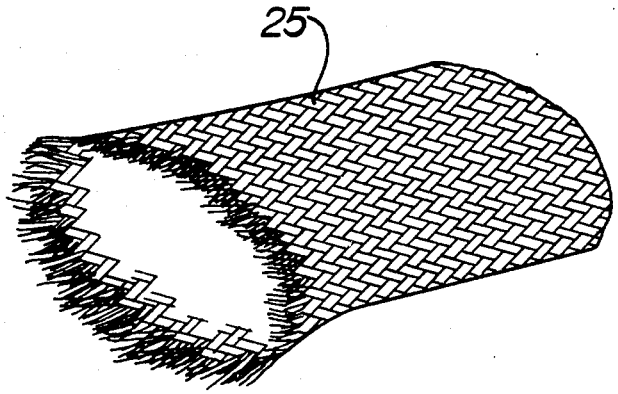
FIG. 8

SKIS

This is a continuation of application Ser. No. 566,062, filed Apr. 8, 1975 and now abandoned.

BACKGROUND OF THE INVENTION

The invention relates to skis.

The use of a single reinforcing glass fiber/resin casing completely enclosing a single-piece light core is known, such a casing extending substantially to the edges of the ski which are fitted with hard protective plates. Such skis are still found to be satisfactory for all-round skiing, but are not suitable for high speed downhill or slalom competitive skiing.

To improve performance, several elongated core elememts of light material, placed side-by-side within the ski and extending along the ski, were each encased in a fiber-glass fabric impregnated with a resin which upon polymerisation solidified and bonded the core elements together and to the surrounding outer case of the ski. The provision of several such encased core elements enabled a notable amelioration of performance, by providing a light ski resistant to torsion while allowing a modulated flexibility along the length of the ski. However, the manufacturing process is clumsy, and the joints between each adjacent fiber/resin case are subject to high stresses, particularly torsional, and are liable to crack and allow penetration of humidity which reduces the useful life of the ski.

A more recent proposal has been the use of a generally Ω-shaped fiber/resin reinforcement embracing but not encasing the central part of a split core. This enables manufacture to be simplified and the risk of cracks to be reduced.

All of these known skis however have a high resistance to lateral flexibility whereby during skiing, especially at high speeds, adaptation of the ski to irregularities of the slope is limited.

SUMMARY OF THE INVENTION

An object of the invention is to provide an improved ski with a reinforced central core, having a good resistance to torsion while allowing both longitudinal and lateral flexibility whereby the ski can adapt particularly well to irregularities in the slope, and manufacture of which is simple.

The invention therefore pertains to a ski of sandwich construction comprising an upper, a lower running sole having hard edges extending therealong, and a solid elongated core sandwiched between said upper and said sole with a first layer of stratified glass fibers in a polymerized resin disposed between said upper and said core and a second layer of stratified glass fibers in a polymerized resin disposed between said sole and said core, said core having a central part and two lateral parts of like material disposed side-by-side, each lateral part having a hard external lateral surface coating.

In such a ski, the invention provides the improvement wherein said core comprises a third layer of glass fibers embedded in a polymerized resin encasing solely said central part of the core along its entire length and about its entire periphery, said third layer bonding said central part to said first and second layers and to said lateral parts of the core.

Preferably, said third layer includes fibers extending longitudinally along the entire length of said central part and fibers extending transversally about said central part.

The rigid, reinforced central part of the core gives the ski remarkable steering characteristics. The relative independence of this central part from the outer edges of the ski enable the latter to efficiently adapt to changes in the slope, while the central part remains very resistant to torsional efforts, such torsional efforts being exerted on the central part of the core with a lesser "lever arm" than in other constructions.

BRIEF DESCRIPTION OF THE DRAWINGS

A preferred embodiment of the invention will now be described, by way of example, with reference to the accompanying drawings, in which:

FIG. 1*a* is a transverse cross-section through a molded core;

FIG. 1*b* shows the core of FIG. 1*a* after cutting;

FIG. 1*c* is a cross-section of the central part of the core encased;

FIG. 2 is a transverse cross-section of the components of a ski, including the core of FIGS. 1*a*, 1*b*, 1*c*, in a press;

FIG. 7 is a schematic perspective view showing a preferred form of fiber-glass fabric for encasing the central part of the core; and FIG. 8 is a schematic perspective view of part of a braided tube of glass-fibers for encasing the central part of the core.

DESCRIPTION OF THE PREFERRED EMBODIMENT

Figure 3:
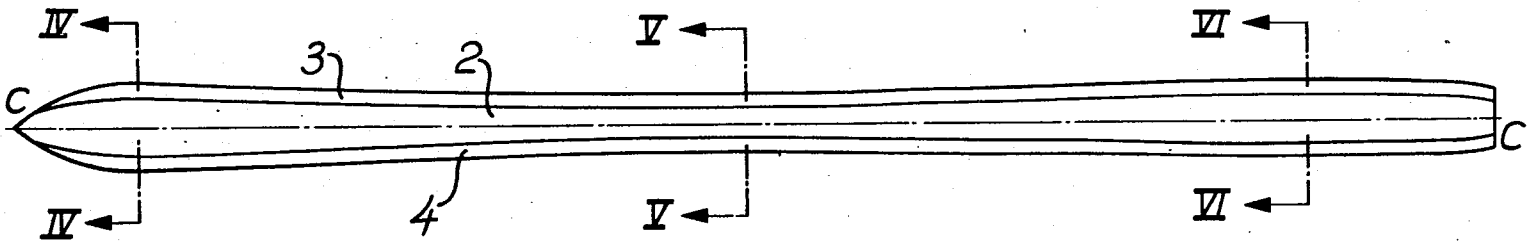
FIG. 3 is a plan view of modified form of ski core.

FIG. 1 shows a central elongated core 1 for incorporation in a ski. The core 1 may be of light wood such as balsa to which hard edge plates 12 and 13 are fitted, but is preferably of expanded polyurethane injection molded in a single operation with the edge plates 12 and 13 incorporated during molding.

The core 1 is cut longitudinally along inclined planes AA, BB to provide a central part 2 of trapezoidal section and two lateral parts 3 and 4 each with a hard edge plate 12, 13 respectively.

FIG. 1*c* shows the central part 2 encased in a fiber-glass fabric sleeve 5 having overlapping edges 5*a*, 5*b* along the narrow upper edge of part 2. Fabric sleeve 5 is preferably, as shown in FIG. 7, formed of a base stratum 20 formed as an open rectangular net 21 supporting long ramdomly oriented fibers 22 onto which are sewn bundles 23 of parallel fibers by means of joining fibers 24. When fabric sleeve 5 is wound about part 2, stratum 20 forms an inner layer and the outer bundles 23 of parallel fibers are disposed along the longitudinal axis of part 2.

Figure 6:
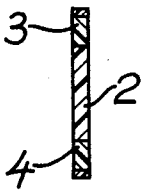
FIGS. 4, 5 and 6 are cross-sections taken respectively along IV—IV, V—V and VI—VI of FIG. 3.
Figure 5:
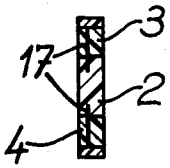
Figure 4:
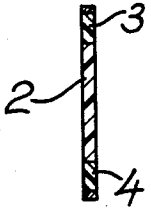

As shown for the varied form of core of FIGS. 3 to 6, in which the cutting planes are perpendicular to the main plane of the core instead of being inclined, the central part 2 varies progressively in width and thickness along ats length. Mid-way along, FIG. 5, part 2 is relatively narrow and thick and is provided internally with reinforcing plates 17 for receiving screws to secure a binding to the ski, whereas its ends (FIGS. 4 and 6) are relatively wide and thin. The periphery of the central part 2 is however substantially constant at all cross-sections along its length, whereby it can be wound in a band or sleeve of fabric 5 of constant width with the edges 5*a*, 5*b* overlapping by a constant amount.

Before application about part 2 with the bundles 23 parallel to the axis C—C of the core (FIG. 3), the fabric 5 is imbibed in a polymerizable epoxy resin including a polymerizing agent. Prior to polymerization, the edges 5*a*, 5*b* are fixed to part 2, by stapling for example.

FIG. 2 shows the components of a ski in a press formed of a base or mold 6 and a top plate 7 to which a uniform pressure is applied during baking. The manufacturing process is as follows.

A lower running sole 8 of polyethylene and fitted with long steel edges 9, 10 is firstly placed in mold 6. A layer 11 composed of several piled sheets of appropriately cut fiberglass, for example a loosely woven fabric formed of bundles of fibers extending along the ski joined by loose transverse fibers, and imbibed in a polymerizable epoxy resin, is then placed in mold 6 on sole 8 and over edges 9, 10. The central part 2 of the core, wrapped as shown in FIG. 1*c*, is then placed centrally on layer 11. Alternatively, part 2 could be wrapped with the imbibed fabric 5 in the mold 6. The lateral parts 3 and 4 of the core, with their fitted edge plates 12 and 13, are then inserted in mold 6 on either side of the encased central part 2, insertion being facilitated by the inclined lateral faces of part 2. A composite layer 14 of fiberglass fabric and resin, similar to layer 11, is then placed on top of the core and extends to the outer face of plates 12, 13. During placing of this composite layer 14, a continuous protective upper strip 15, for example of Zicral (Trade Mark), is inserted at the periphery. A hard, scratch resistant upper layer 16, for example of the plastic material available under the Trade Name ABS, which can also be used for side plates 12, 13 and reinforcing plates 17, is then fitted and the assembly is compresed uniformly by plate 7 with the application of heat to polymerize the resins, and solidify the assembly. After polymerization, the ski is removed from the press and subjected to the usual finishing operations.

As a result of polymerization, the sleeve 5 about part 2 is formed into a reinforcing central case resistant to torsional stresses. The longitudinal disposition of the principal fibers in layers 5, 11 and 14 generally parallel to axis C—C of the core and of the ski, allows a good longitudinal flexibility particularly of the front and rear ends of the ski. The layer 5 bonds central part 2 of the core to the upper and lower reinforcing layers 14, 11 and to the lateral parts 3 and 4, while allowing a relatively great feedom of the central part 2 whereby the ski has a great lateral flexibility.

The layers 11 and 14 need not be reduced at their edges to accomodate for strip 15 or edges 9 and 10; this ensures that upon compression, the resin in layers 11 and 14 is squeezed inwards to provide a high resin content and hence greater rigidity in from the edges. However, if desired the core 1, instead of having straight upper and lower edges in cross-section could for example have an appropriate stepped shape to provide a more uniform distribution of the resin upon compression.

Instead of using the fabric shown in FIG. 7 to encase the central part 2, a tube 25 of braided bundles of fibers (FIG. 8) could be used, this being imbibed with resin and drawn over part 2. Both types of fabric include fibers extending along the entire length of part 2, and transverse fibers. The transverse fibers serve to ensure a good bond, particularly with lateral parts 3 and 4. A braided tube 15 could also be coated with bundles of sewn-on longitudinal fibers, as 23 of FIG. 7. To increase rigidity of the median part of the ski, an additional layer of fiberglass fabric may be wound around a limited length of part 2, under or over layer 5.

What is claimed is:

1. In a ski of sandwich construction comprising an upper, a lower running sole having hard edges extending therealong, and an elongated core sandwiched between said upper and said sole with a first layer of stratified glass fibers in a polymerized resin disposed between said upper and said core and a second layer of stratified glass fibers in a polymerized resin disposed between said sole and said core, said core having a central part and two lateral parts of like solid material disposed side-by-side, each lateral part having directly thereon a hard external lateral surface coating outwardly of the core, the improvement wherein said core comprises a sleeve of glass fibers embedded in a polymerized resin circumferentially encasing solely said central part of the core along its entire length and about its entire axial periphery, each said lateral part being free of encasement by said encasing sleeve, said sleeve and resin herewith bonding said central part of the core to said first and second layers of stratified glass fibers and directly bonding said central part of the core to each said lateral part of the core, and resin in said first and second layers bonding said lateral parts of the core directly to said first and second layers of stratified glass fibers.

2. A ski according to claim 1, in which said sleeve includes fibers disposed longitudianlly along the entire length of said central part, and fibers disposed transversel, about said central part.

3. A ski according to claim 2, in which said sleeve includes an inner stratum of fibers oriented generally at random and an outer stratum of fibers principally extending longitudinally along said central part.

4. A ski according to claim 3, in which said outer stratum of fibers has bundles of parallel fibers united to said lower stratum by joining fibers.

5. A ski according to claim 2, in which said sleeve includes a plaited tube of bundles of fibers.

6. A ski according to claim 1, in which said central and said lateral parts of the core have at any cross-section thereof at least substantially the same thickness.

7. A ski according to claim 6, in which the width and thickness of said central part of the core vary progressively along the length of the ski, said central part having a narrow thick portion generally mid-way along the ski and relatively wide thin end portions, the periphery of said central part remaining substantially constant at all cross-sections along its length.

8. A ski according to claim 7, in which said central part of the core is of trapezoidal was section having a narrow face adjacent said upper, a wide face adjacent said sole and inclined outer lateral faces facing complementary inclined inner lateral faces of said lateral parts.

* * * * *